United States Patent [19]

Rösler et al.

[11] 4,225,256

[45] Sep. 30, 1980

[54] PEN NIB WITH SLIT FOR LIQUID INKS

[75] Inventors: Jürgen Rösler, Hamburg-Blankenese; Günther Herrnring, Alvesloe, both of Fed. Rep. of Germany

[73] Assignee: Montblanc-Simplo GmbH, Hamburg, Fed. Rep. of Germany

[21] Appl. No.: 885,495

[22] Filed: Mar. 13, 1978

[30] Foreign Application Priority Data

Mar. 12, 1977 [DE] Fed. Rep. of Germany ..... 2710919

[51] Int. Cl.[3] ..... B43K 7/00

[52] U.S. Cl. ..... 401/209; 15/445; 401/216

[58] Field of Search ..... 401/209, 212, 216, 221, 401/231; 15/445, 447

[56] References Cited

U.S. PATENT DOCUMENTS

| | | | |
|---|---|---|---|
| 2,487,340 | 11/1949 | Kleinsmith | 401/209 X |
| 2,592,406 | 4/1952 | Faltin | 401/216 |
| 2,699,148 | 1/1955 | Schweiger et al. | 15/445 X |

FOREIGN PATENT DOCUMENTS

| | | | |
|---|---|---|---|
| 805990 | 3/1951 | Fed. Rep. of Germany | 401/209 |
| 464200 | 12/1951 | Italy | 401/209 |

*Primary Examiner*—Edward M. Coven

*Attorney, Agent, or Firm*—Becker & Becker, Inc.

[57] ABSTRACT

A pen nib provided with a slit for liquid inks, in which the front end of the nib is at its underside provided with a ball-point tip which extends substantially perpendicular to the writing plane, and the ball bed of which is associated with the slit in the nib in an ink transmitting manner.

5 Claims, 4 Drawing Figures

PEN NIB WITH SLIT FOR LIQUID INKS

This invention relates to a pen nib provided with a slit for liquid inks.

Despite the numerous advantages of ball-point pens, pens with nibs and liquid ink are still retained. This is attributable to the fact that when writing with liquid inks, a more characteristic writing pattern results and the written article has a more personal note. It must also be mentioned, however, in connection with nib-type pens that these have a considerably more pleasant writing behavior because the nib provided with a slit has an inherent resilience which makes writing more pleasant and less tiring. When quick-drying liquid inks are used with nib-type pens, however, a disadvantage results which is known by the English technical expression "feathering". This "feathering" means that—according to the kind of paper used—the ink lines do not have sharply outlined contours but fray, that is to say the coloring by the ink extends into individual fibers of the paper adjacent to the ink line. This characteristic is almost completely absent in ball-point pens because with these the ball wetted with the ink paste rolls on the paper. However, even the best nib-type pen, used with very good papers, causes a degree of "feathering" depending on the temperament of the writer, which "feathering" is caused by the "scratching" of the pen.

It is therefore the object of the present invention to modify a pen adapted for liquid ink and comprising a slit so that it is comparable with ball-boint pen writing with regard to the feathering, without the resilient writing behavior of the pen being adversely affected.

In order to solve the above mentioned problem, there is provided, according to the invention, a pen nib provided with a slit for liquid inks characterized in that the front end of the nib carries at its under side a ball-point tip which is aligned substantially perpendicular to the writing plane and the ball bed of which is associated with the nib slit in an ink-transmitting manner. The ball-point tip is preferably secured to a bracket which positively surrounds the limbs of the nib with a play which renders possible the opening of the slit in the nib. The positive connection can be achieved as a result of the fact that a pin-shaped member which is slit centrally in the longitudinal direction of the nib is allowed to engage with radial play in the bore of the ball-point tip, with the two halves of the pin-shaped member being rigidly connected to the under sides of the limbs of the nib and its longitudinal slit forming an extension of the slit in the nib.

Since the ball-point tip scarcely exceeds millimeter size in dimensions, the pen nib substantially retains its conventional appearance so that no aesthetic impairment occurs.

Further details and features of the invention are apparent from the following detailed description and the accompanying drawing in which a preferred form of embodiment of the invention is illustrated by way of example.

Figure 1:
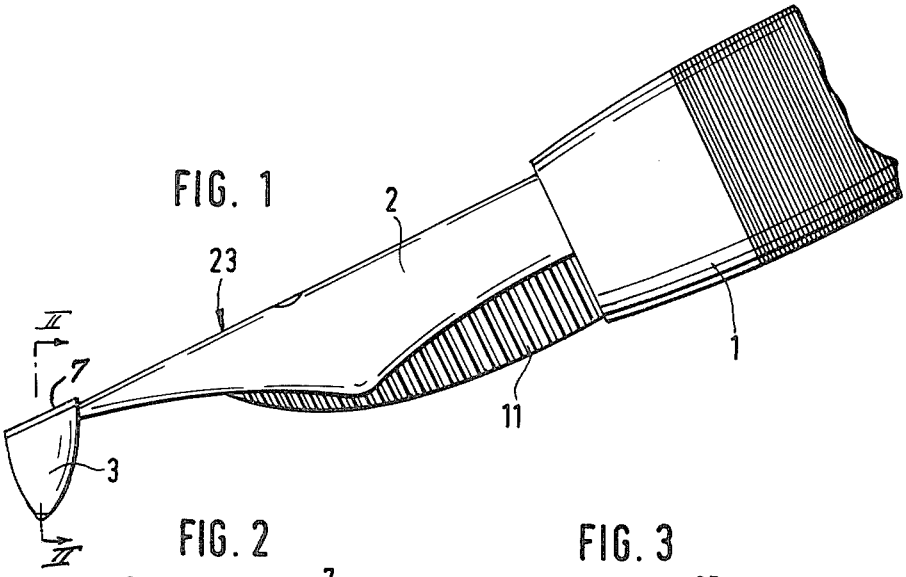
FIG. 1 shows a perspective side view of the front end of a fountain pen with a nib constructed according to the invention.
Figure 4:
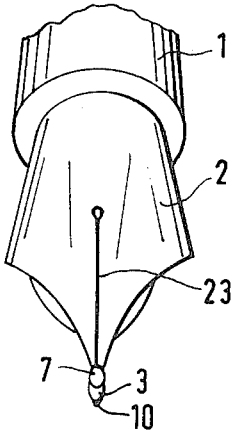
FIG. 4 shows a perspective plan view of the nib according to the invention.

FIG. 1 shows the pen nib according to the invention at the front end 1 of a fountain pen provided with a feed means 11. As FIGS. 1 and 4 show, the nib 2 has substantially retained its conventional appearance. It comprises the usual central hole and also the slit 23 in the nib which extends to the tip of the nib.

As distinct from the usual pen nibs, however, a ball-point tip 3 is secured to the front end of the nib 2. This ball-point tip 3 is cut off somewhat obliquely in relation to its longitudinal axis because it is intended to be aligned substantially perpendicular to the writing plane when held in the writing position indicated by way of example in FIG. 1.

Figure 2:
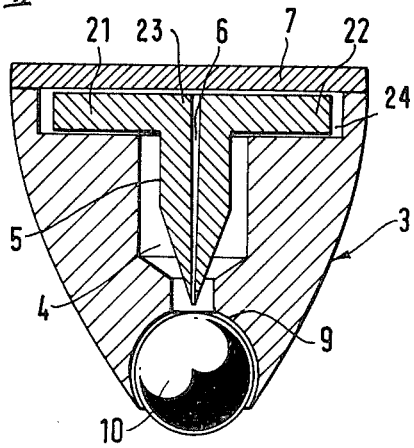
FIGS. 2 and 3 show cross-sections on an enlarged scale on the section line II—II of FIG. 1 respectively with the slit in the nib closed in the position of rest and with the slit in the nib somewhat open during writing.
Figure 3:
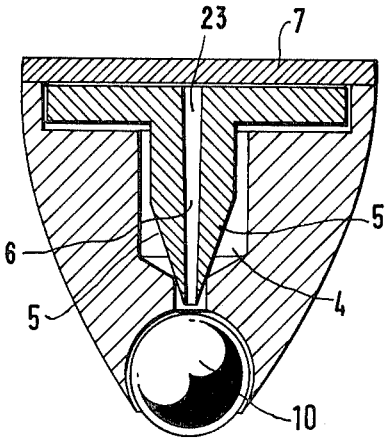

As FIGS. 2 and 3 show, the cut face of the ball-point tip 3 is connected to a small bracket or plate 7 which is visible on the surface of the nib 2 and which serves as a holding bracket. The top portion of the ball-point tip 3 adjacent to the plate 7 is formed with a recess 24 so that it can receive the two limbs 21, 22 of the nib 2, which are separated by the slit 23 in the nib, with clearance.

In order to prevent the ball-point tip 3 from falling down off the front end of the nib 2, a pin or pin-shaped member 5 is disposed at the under side of the nib 2. This pin 5, which is substantially cylindrical in cross-section projects with its pointed free end into the longitudinal bore 4 in the tip 3 and extends close to the ball 10 mounted in the ball bed or ball-point bed 9. The pin 5 is provided with a slit 6 in the longitudinal direction of the nib, which slit 6 forms an extension of the slit 23 in the nib 2. The pin 5 with its longitudinal slit 6 may appropriately be produced in such a manner that first an undivided pin is welded to the still undivided nib, and then the longitudinal slit 6 is produced simultaneously with the production of the slit 23 in the nib. This longitudinal slit 6 can then "breathe" in the same way as the slit 23 in the nib.

The dimensioning between the ball-point tip, covering plate 7 and the limbs of the nib is selected so that the free mobility of the nib, that is to say the resilient writing feel of the latter, is not adversely affected. In connection with FIGS. 2 and 3, it should be pointed out that the interior transverse dimension of the ball-point tip 3 must be selected so that the slit in the nib can open sufficiently in the manner provided during writing. Apart from this, of course, all the ink paths are so dimensioned that there is a constantly rising capillarity in the direction of the bearing gap between ball 10 and ball bed 9, that is to say the cross-sectional areas of passage for the ink must become constantly smaller towards the ink-delivery end of the nib. The invention is not restricted to the form of embodiment described above, for there are many possibilities for one skilled in the art to connect the ball-point tip to a pen nib positively in an ink-transmitting manner so that the slit in the nib can still "breathe". There is also the possibility of using a fiber-metal member to transmit the ink from the slit in the nib of the surface of the ball 10, which member passes on the ink like a sponge and also insures a positive fit of the ball-pen refill tip on the pen nib.

What we claim is:

1. A pen nib for liquid inks which comprises:

a slit extending in the longitudinal direction of said nib to the front and thereof, said slit dividing the front end of said nib into two limbs;

a ball-point bed, and a ball-point tip carrying said ball-point bed and arranged on the underside of said nib in the vicinity of and in fluid communication with said slit, said ball-point tip being adapted to form an angle of about 90° with a writing plane when said pen nib is in its writing position, and being provided with a bore;

a pin-shaped member engaging said bore with radial play, said pin-shaped member having a centrally arranged slit locatable in the same plane with and extending in the longitudinal direction of said slit in said nib to provide two sections joined to and forming with said two limbs a structure of T-shaped cross section; and a ball rotatably arranged in said bed.

2. A pen nib according to claim 1, wherein said ball-point tip is movable relative to at least one of said two limbs.

3. A pen nib according to claim 1, which includes a bracket which is connected to the front portion of said pen nib and which has connected thereto said ball-point tip, said ball-point tip and said bracket positively surrounding said two limbs with a clearance rendering possible the temporary widening of at least said slit in said nib.

4. A pen nib according to claim 1, in which said pin-shaped member has a conical portion with the tip thereof ending in the vicinity of said ball-point bed.

5. A pen nib according to claim 4, in which said ball-point tip has a portion which is near said nib and is provided with a recess adapted to receive said two limbs with a clearance rendering possible the temporary widening of said slit in said nib.

* * * * *